US007493076B2

(12) United States Patent
Chang

(10) Patent No.: US 7,493,076 B2
(45) Date of Patent: Feb. 17, 2009

(54) PAPER DISCHARGE GUIDE UNIT AND WET IMAGE FORMING APPARATUS HAVING THE SAME

(75) Inventor: Woong-Jae Chang, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 521 days.

(21) Appl. No.: 11/246,153

(22) Filed: Oct. 11, 2005

(65) Prior Publication Data

US 2006/0083569 A1 Apr. 20, 2006

(30) Foreign Application Priority Data

Oct. 18, 2004 (KR) ..... 10-2004-0082996

(51) Int. Cl.
*G03G 15/00* (2006.01)

(52) U.S. Cl. ..... 399/405; 399/361

(58) Field of Classification Search ..... 399/405, 399/361

See application file for complete search history.

(56) References Cited

U.S. PATENT DOCUMENTS 5,016,060 A * 5/1991 Arai ..... 399/400
5,130,752 A * 7/1992 Morishita et al. ..... 399/315
5,842,104 A * 11/1998 Hazama et al. ..... 399/400
6,064,852 A * 5/2000 Maekawa ..... 399/397
7,263,327 B2 * 8/2007 Nagayama ..... 399/405
2002/0041303 A1 * 4/2002 Yoshinaga ..... 347/22

FOREIGN PATENT DOCUMENTS

| | | |
|---|---|---|
| JP | 03-137666 | 6/1991 |
| JP | 05-032340 | 2/1993 |
| JP | 05-289450 | 11/1993 |
| JP | 09-044001 | 2/1997 |
| KR | 201148 | 12/1999 |

* cited by examiner

*Primary Examiner*—Anthony H. Nguyen
(74) *Attorney, Agent, or Firm*—Roylance, Abrams, Berdo & Goodman, L.L.P.

(57) ABSTRACT

A paper-discharging guide unit for guiding a printing paper to be discharged outside a wet electrophotographic image forming apparatus and for absorbing volatile organic compound gases soaked in the printing paper comprises a guide frame forming a discharge passage for the printing paper, a plurality of guide ribs formed in pairs of slanted lines symmetrical with respect to a centerline of the discharge direction of the printing paper of the guide frame inside the guide frame and guiding the printing paper, and an air-absorbing portion disposed below the guide frame and absorbing air from a plurality of spaces between the guide frame and the plurality of guide ribs.

17 Claims, 8 Drawing Sheets

PAPER DISCHARGE GUIDE UNIT AND WET IMAGE FORMING APPARATUS HAVING THE SAME

CROSS-REFERENCE TO RELATED APPLICATIONS

This application claims the benefit under 35 U.S.C. § 119 (a) of Korean Application No. 2004-82996, filed on Oct. 18, 2004, in the Korean Intellectual Property Office, the entire disclosure of which is incorporated herein by reference.

BACKGROUND OF THE INVENTION

1. Field of the Invention

The present invention relates to a wet type image forming apparatus. More particularly, the present invention relates to a paper discharge guide unit for guiding a printing paper passed through a fusing unit toward a pair of discharging rollers in a wet type electrophotographic image forming apparatus.

2. Description of the Related Art

In general, a liquid toner used for a wet type electrophotographic image forming apparatus is composed of toner particles and a liquid that is used as a carrier of the toner particles. The carrier liquid contains volatile organic compounds. Therefore, when a printing paper, onto which a predetermined image developed by the liquid toner in an image forming unit of the wet type electrophotographic image forming apparatus was transferred, passes through a fusing unit, some of the volatile organic compounds of the liquid toner are evaporated by the heat and pressure of the fusing unit and some of the resultant gaseous compounds soak into the printing paper. When the printing paper is being discharged from the fusing unit outside the wet electrophotographic image forming apparatus (hereinafter referred to as a wet image forming apparatus), the volatile organic compound gases, which soaked into the printing paper in the fusing unit, are emitted from the printing paper. If the gases are not fully emitted before the paper is discharged from the printer, the gases are emitted to the atmosphere. Also, if the wet image forming apparatus cannot treat all of the captured gases, untreated volatile organic compound gases enter the atmosphere. The volatile organic compound gases are a pollutant, and may cause users to feel ill. Furthermore, environmental protection laws may restrict the emission of the gases. Therefore, wet image forming apparatuses have various types of paper discharging units to absorb and remove all of the volatile organic compound gases that are soaked in the printing paper before the printing paper is discharged to the atmosphere. An example of one such paper discharging units is shown in FIG. 1.

Referring to FIG. 1, a conventional paper-discharging guide unit 1 has a discharge guide plate 10 and an air absorbing portion (not shown). The discharge guide plate 10 has a guide frame 11 and a plurality of guide ribs 13. The guide frame 11 is formed in the shape of a hollow rectangle, namely, a shape similar to a rectangular window frame. The plurality of guide ribs 13 are located inside the frame. The plurality of guide ribs 13 are disposed inside the guide frame 11 and are parallel to the direction of movement of a printing paper P passing above the discharge guide plate. Therefore, there are a plurality of spaces between the guide frame 11 and the plurality of guide ribs 13 of the discharge guide plate 10.

The air-absorbing portion is disposed below the discharge guide plate 10 to absorb air from the plurality of spaces between the guide frame 11 and the plurality of guide ribs 13.

The air-absorbing portion is comprised of a duct (not shown) that is fluidly connected to the guide frame 11 and an absorbing fan (not shown) that generates a suction force.

The operation of the paper-discharging guide unit 1 to remove volatile organic compound gases from the printing paper being discharged will now be explained.

When the printing paper P passed through the fusing unit (not shown) moves onto the discharge guide plate 10, the absorbing fan (not shown) of the air-absorbing portion operates and thereby generates the suction force. The suction force is applied to the printing paper P moving on the discharge guide plate 10 through the plurality of spaces between the guide frame 11 and the plurality of guide ribs 13 of the discharge guide plate 10. The volatile organic compound gases, which are emitted from the printing paper P or are soaked in the printing paper P, are absorbed into the air-absorbing portion. The printing paper P with the volatile organic compound gases removed is discharged outside of the wet image forming apparatus. The volatile organic compound gases absorbed by the air-absorbing portion are decomposed into harmless gases by an exhaust gas decomposing apparatus (not shown) and then are exhausted to the atmosphere.

The paper-discharging guide unit 1 described above may cause problems, however. First, the suction force may generate an uneven flow of the volatile organic compound gases and/or of air may in the plurality of spaces 15 between the guide frame 11 and the plurality of guide ribs 13. Due to the flow, the suction force may not be uniformly applied to the printing paper P moving above the discharge guide plate 10. When the suction force is not uniformly applied to the printing paper P, one or both corner of a leading end of the printing paper P may be bent in the direction of the suction force. When the printing paper P having one or both bent corners passes through a pair of discharging rollers (not shown), one or both corners of the printing paper P are folded.

Second, the suction force is not applied to the area of the printing paper P that touches the plurality of guide ribs 13 because the plurality of guide ribs 13 block the suction force. And, since the plurality of guide ribs 13 is disposed parallel to the discharge direction of the printing paper P, the suction force is not applied to the area 19 of the printing paper P that touches the plurality of guide ribs 13. In other words, while the printing paper P is moving from S1 position to S2 position, the area 19 of the printing paper P that touches the plurality of guide ribs 13 continuously contacts the plurality of guide ribs 13. Therefore, the volatile organic compound gases soaked in the area 19 of the printing paper P are not absorbed by the air-absorbing portion and remain in the paper. In the worst case, the volatile organic compound gases emitted from the area 19 of the printing paper P condense into a liquid between the plurality of guide ribs 13 and the printing paper P, and the liquid contaminates the printing paper P.

Accordingly, there is a need for a wet image forming apparatus with an improved apparatus for removing volatile organic compound gases soaked in paper.

SUMMARY OF THE INVENTION

An aspect of the present invention is to solve at least the above problems and/or disadvantages and to provide at least the advantages described below. Accordingly, an aspect of the present invention is to provide a paper-discharging guide unit in which one or both corners of a leading end of a printing paper are not bent by a suction force when the printing paper moves above a discharge guide plate.

It is another aspect of the present invention to provide a paper-discharging guide unit which can completely absorb volatile organic compound gases soaked into a printing paper because a suction force is applied to the entire area of the printing paper while the printing paper passes through a discharge guide plate.

It is still another aspect of the present invention to provide a wet electrophotographic image forming apparatus having a paper-discharging guide unit which does not cause a corner of a leading end of a printing paper to be bent by a suction force and can completely absorb volatile organic compound gases soaked in the printing paper.

Additional aspects and/or advantages of the present invention will be set forth in part in the description which follows and, in part, will be obvious from the description or the practice of the invention.

The above aspects and advantages of the present invention are accomplished by a paper-discharging guide unit that has a guide frame forming a discharge passage for a printing paper. A plurality of guide ribs formed in pairs of slanted lines that are symmetrical with respect to a centerline of the guide frame are located inside the guide frame. The guide ribs guide the printing paper. An air-absorbing portion disposed below the guide frame absorbs air from a plurality of spaces between the guide frame and the plurality of guide ribs.

The plurality of guide ribs are slanted so that they diverge in the discharge direction of the printing paper.

The paper-discharging guide unit may further comprise a plurality of branch ribs disposed downstream of the plurality of guide ribs. The branch ribs may be formed so that they are slanted steeper with respect to the centerline of the guide frame than the plurality of guide ribs.

The plurality of guide ribs or branch ribs may be disposed so that the distance between the two points where a pair of guide ribs or branch ribs meet on the downstream side of the guide frame correspond to a width of the printing paper guided by the guide frame.

Also, the plurality of guide ribs may be formed in the shape of slanted lines that do not meet inside the guide frame.

Another aspect of the present invention is to provide a wet electrophotographic image forming apparatus with a fusing unit that fixes an image on a printing paper. A guide frame guides the printing paper passing through the fusing unit. A plurality of guide ribs are formed in pairs of slanted lines and are symmetrical with respect to a centerline of the guide frame. The guide ribs are located inside the guide frame and support the printing paper. An air-absorbing portion is disposed below the guide frame and absorbs volatile organic compound gases that are contained in the printing paper through a plurality of spaces between the guide frame and the plurality of guide ribs. A pair of discharging rollers discharge the printing paper passed through the guide frame.

The plurality of guide ribs may be formed to be slanted to diverge toward the discharge direction of the printing paper. A plurality of branch ribs may be disposed downstream of the plurality of guide ribs. The branch ribs may be formed so that they are slanted steeper with respect to the centerline of the guide frame than the plurality of guide ribs.

The plurality of guide ribs or branch ribs may be disposed so that the distance between the two points where a pair of guide ribs or branch ribs meet on the downstream side of the guide frame correspond to a width of the printing paper guided by the guide frame.

In the paper-discharging guide unit according to the present invention, one or both corners of the printing paper passing above the discharge guide plate are not folded by the suction force since the printing paper is supported by the plurality of guide ribs and branch ribs in a shape of a letter 'V.'

Also, in the paper-discharging guide unit according to the present invention, while the printing paper is passing through the discharge guide plate, the suction force is applied to the entire area of the printing paper since the printing paper is supported by the plurality of guide ribs and branch ribs in a shape of a letter 'V.' Therefore, the volatile organic compound gases soaked in the printing paper in the fusing unit are completely absorbed into the air-absorbing portion and removed.

The wet image forming apparatus having the paper-discharging guide unit according to the present invention completely absorbs the volatile organic compound gases soaked in the printing paper in the fusing unit and does not fold the corners of the printing paper by suction force.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
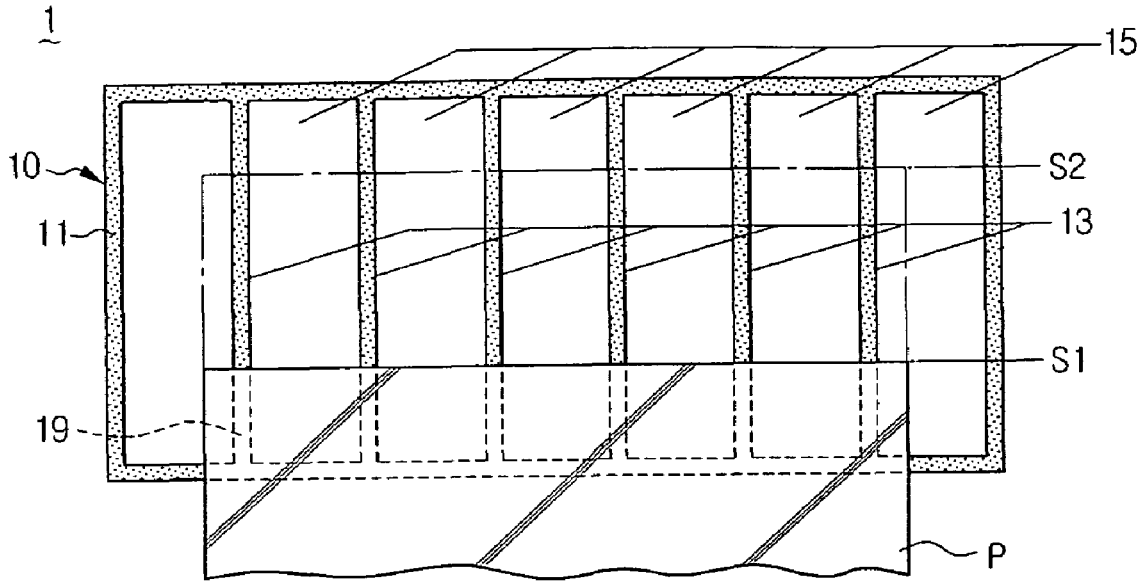
FIG. 1 (RELATED ART)
FIG. 1 is a plan view of a conventional paper-discharging guide unit.
Figure 2:
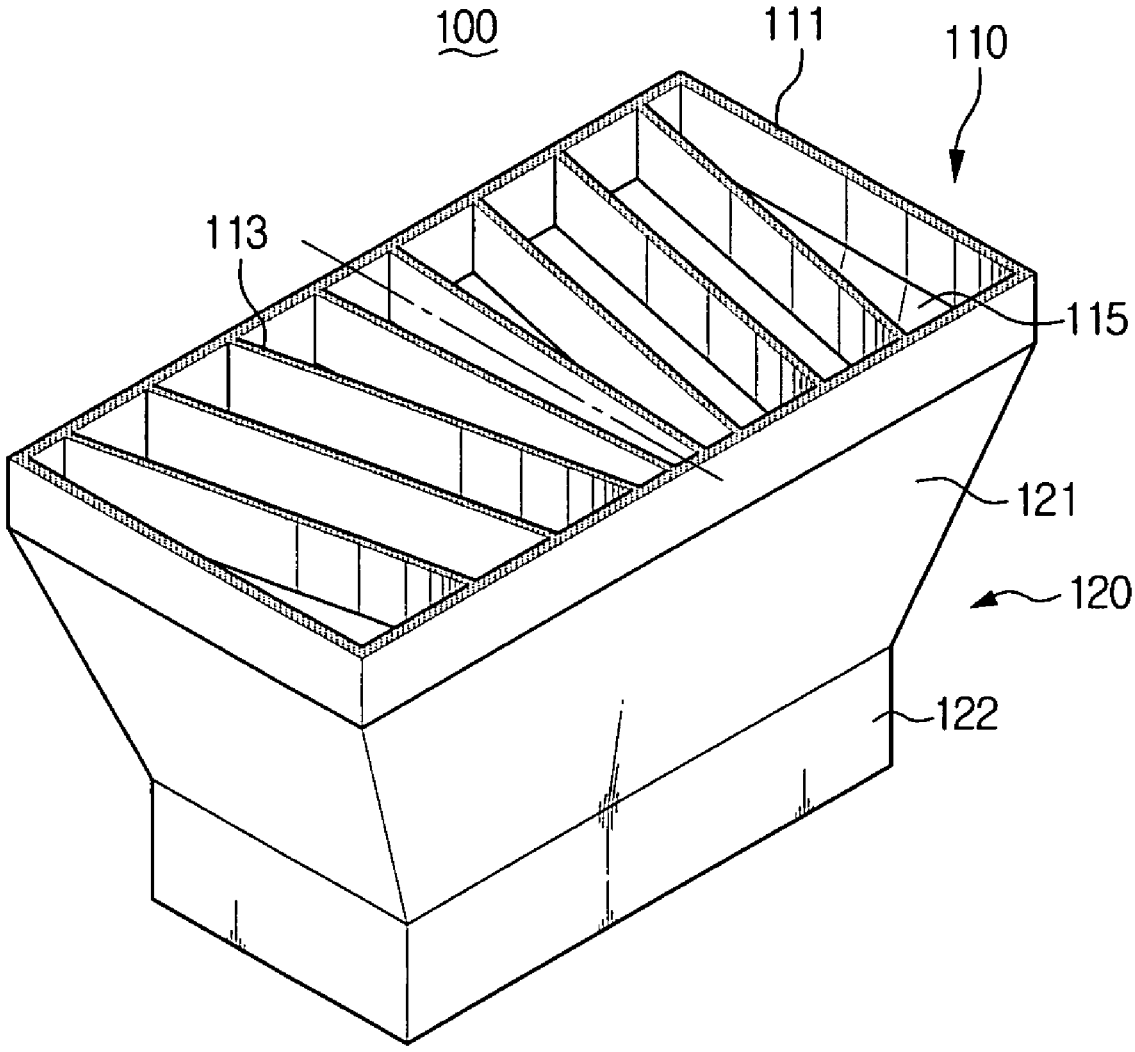
FIG. 2 is a perspective view of a paper-discharging guide unit according to an embodiment of the present invention.

Referring to FIG. 2, a paper-discharging guide unit 100 according to an embodiment of the present invention comprises a discharge guide plate 110 and an air-absorbing portion 120.

The discharge guide plate 110 is disposed between a fusing unit 240 (see FIG. 8) and a pair of discharging rollers 250 (see FIG. 8) and guides a printing paper passed through the fusing unit 240 toward the pair of discharging rollers 250. The discharge guide plate 110 has a guide frame 111 that forms a moving passage of the printing paper. A plurality of guide ribs 113 are disposed inside the guide frame 111 and support the printing paper moving thereon. There are a plurality of spaces 115 between the guide frame 111 and the plurality of guide ribs 113.

The guide frame 111 is formed in the shape of a hollow rectangle, namely, a shape similar to a rectangular window frame.

Figure 3:
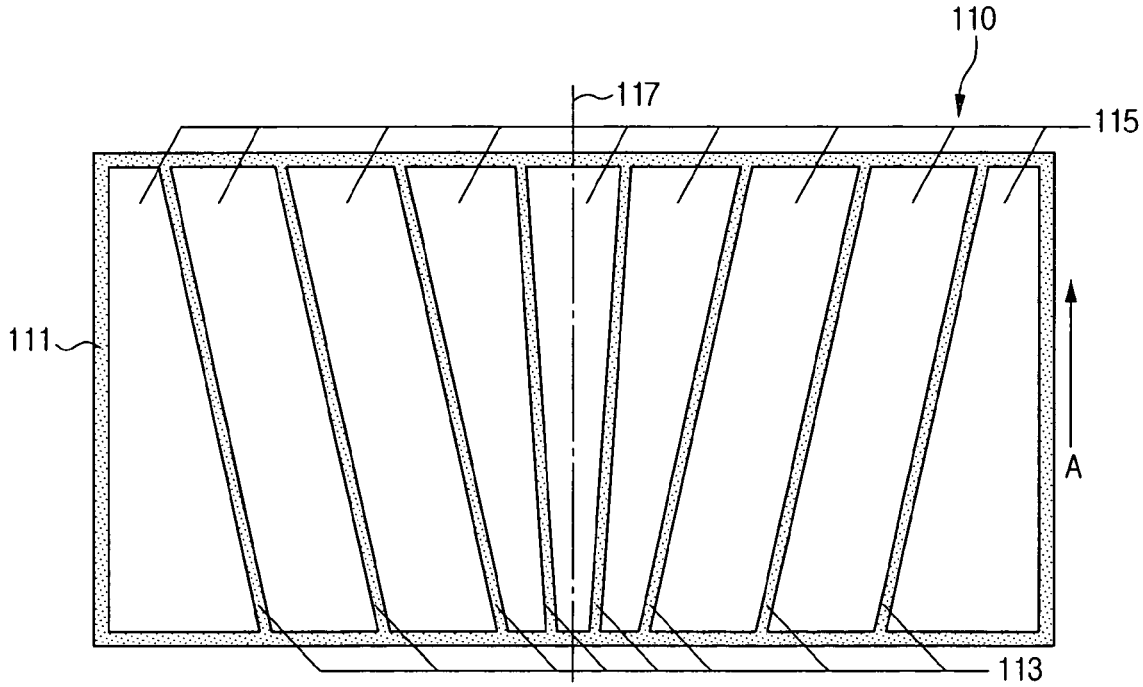
FIG. 3 is a plan view of a discharge guide plate of the paper-discharging guide unit shown in FIG. 2.

The plurality of guide ribs 113 are disposed inside the guide frame 111 and are slanted in the discharge direction of the printing paper. The plurality of guide ribs 113, as shown in FIG. 3, are symmetrical with respect to a centerline 117 of the discharge direction of the printing paper of the guide frame 111. The plurality of guide ribs 113 diverge when moving downstream in the discharge direction (see arrow A) of the printing paper. In other words, as shown in FIG. 3, the plurality of guide ribs 113 are formed in the shape of a letter 'V,' with the apex of the V pointing in the upstream direction of the printing paper. The plurality of guide ribs 113 may be formed in a truncated V-shape. In other words, pairs of symmetrical guide ribs do not meet each other in the centerline 117 inside the guide frame 111.

Figure 4:
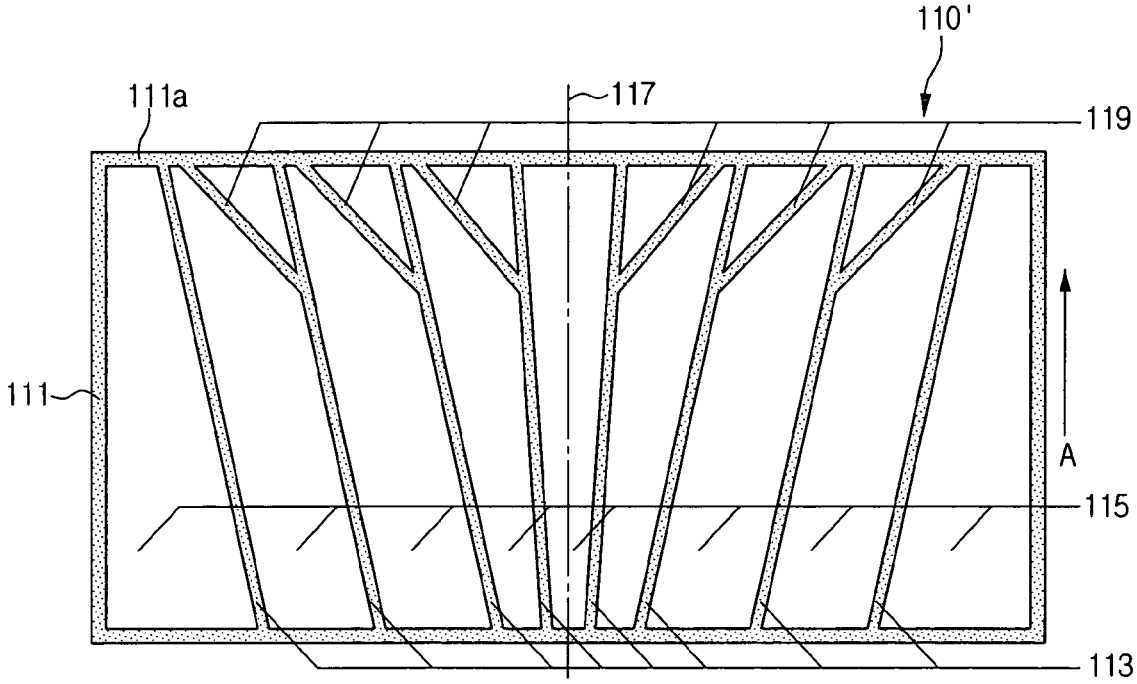
FIG. 4 is a plan view of a second embodiment of a discharge guide plate of the paper-discharging guide unit shown in FIG. 2.
Figure 6:
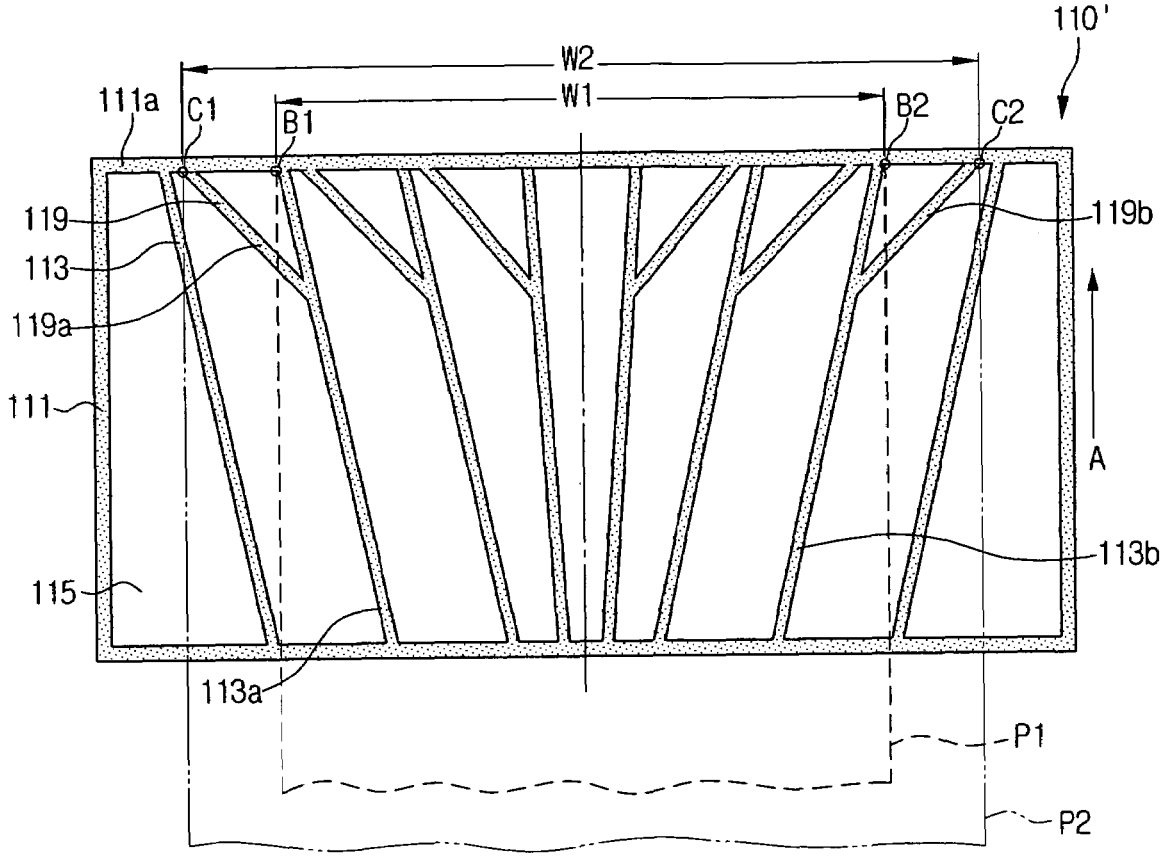
FIG. 6 is a plan view that illustrates the relation between a discharge guide plate of the paper-discharging guide unit shown in FIG. 2 and a width of a printing paper.

FIG. 4 shows a second embodiment of the discharge guide plate. Referring to FIG. 4, the discharge guide plate 110' has a guide frame 111 that forms a moving passage of the printing paper. A plurality of guide ribs 113 and branch ribs 119 are disposed inside the guide frame 111 and support the printing paper moving thereon. A detailed explanation of the guide frame 111 and the plurality of guide ribs 113 will not be repeated since they are similar to those of the discharge guide plate 110 of the first embodiment described above. The plurality of branch ribs 119 are disposed between the plurality of guide ribs 113 in the downstream direction of the printing paper. Each of the plurality of branch ribs 119 is slanted steeper than each of the plurality of guide ribs 113 is slanted to the centerline 117 of the guide frame 111. Preferably, the angle between each of the plurality of branch ribs 119 and the centerline 117 is chosen so that an end of each of the plurality of branch ribs 119 connects with a downstream side 111*a* of the guide frame 111 (that is, the side of the guide frame which is farthest downstream in the discharge direction of the printing paper). The plurality of guide ribs 113 and branch ribs 119 are preferably located so that the points where a pair of guide ribs 113*a*, 113*b* or branch ribs 119*a*, 119*b* intersect with the downstream side 111*a* of the guide frame 111 correspond to a width of a predetermined printing paper guided by the guide frame 111, as shown in FIG. 6. For example, when a width of a printing paper P1 is W1, the slope of one pair of guide ribs 113*a*, 113*b* is chosen so that the printing paper P1 should pass the two points B1, B2 where the pair of guide ribs 113*a*, 113*b* meet with the downstream side 111*a* of the guide frame 111. When a width of another printing paper P2 is W2, a slope of another pair of branch ribs 119*a*, 119*b* of the plurality of branch ribs 119 is chosen so that the printing paper P2 should pass two points C1, C2 where the pair of branch ribs 119*a*, 119*b* meet with the downstream side 111*a* of the guide frame 111. When the discharge guide plate 110 does not have branch ribs 119, as shown in FIG. 3, the slope of each of the plurality of guide ribs 113 is chosen so that two points where a pair of guide ribs meet with the downstream side 111*a* of the guide frame 111 correspond to a width of the printing paper being used.

Figure 5:
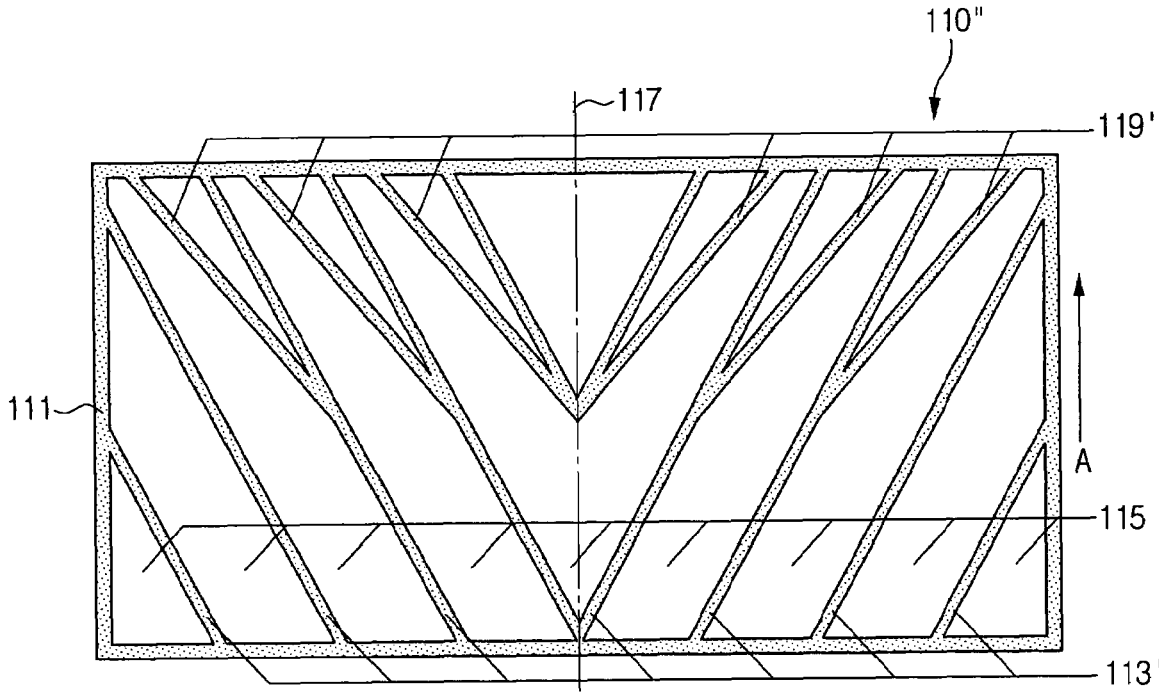
FIG. 5 is a plan view of a third embodiment of a discharge guide plate of the paper-discharging guide unit shown in FIG. 2.

FIG. 5 shows a third embodiment of the discharge guide plate. The discharge guide plate 110" shown in FIG. 5 includes a guide frame 111 and a plurality of guide ribs 113' and branch ribs 119' (the same as the discharge guide plate 110' described above). In contrast to the previous embodiments, however, some of the plurality of guide ribs 113' meet each other at the centerline 117 of the discharge direction A of the printing paper inside the guide frame 111.

In addition to the exemplary discharge guide plates 110, 110', 110" described above, various types of discharge guide plates that correspond to the various width of various types of printing papers are possible. Furthermore, various configurations of the plurality of guide ribs 113 or branch ribs 119 are possible.

The air-absorbing portion 120 is disposed below the discharge guide plate 110 to absorb air from the plurality of spaces 115 between the guide frame 111 and the plurality of guide ribs 113 and branch ribs 119 (see FIG. 4) of the discharge guide plate 110. The air-absorbing portion 120 is comprised of a duct 121 that is connected to a lower portion of the guide frame 111 and an absorbing fan 122 that is disposed at an end of the duct 121. The duct 121 and the absorbing fan 122 can be arranged in various ways according to the structure of the wet image forming apparatus. The duct 121 shown in FIG. 2 is one example of a suitable configuration. The absorbing fan 122 generates a suction force that can absorb the volatile organic compound gases from the printing paper passing above the discharge guide plate 110. Therefore, the capacity of the absorbing fan 122 is determined according to the type of printing paper and the dimension of the duct 121. Also, the absorbing fan 122 is fluidly connected to an exhaust gas decomposing apparatus (not shown) that decomposes the volatile organic compound gases into harmless gases.

Figure 7:
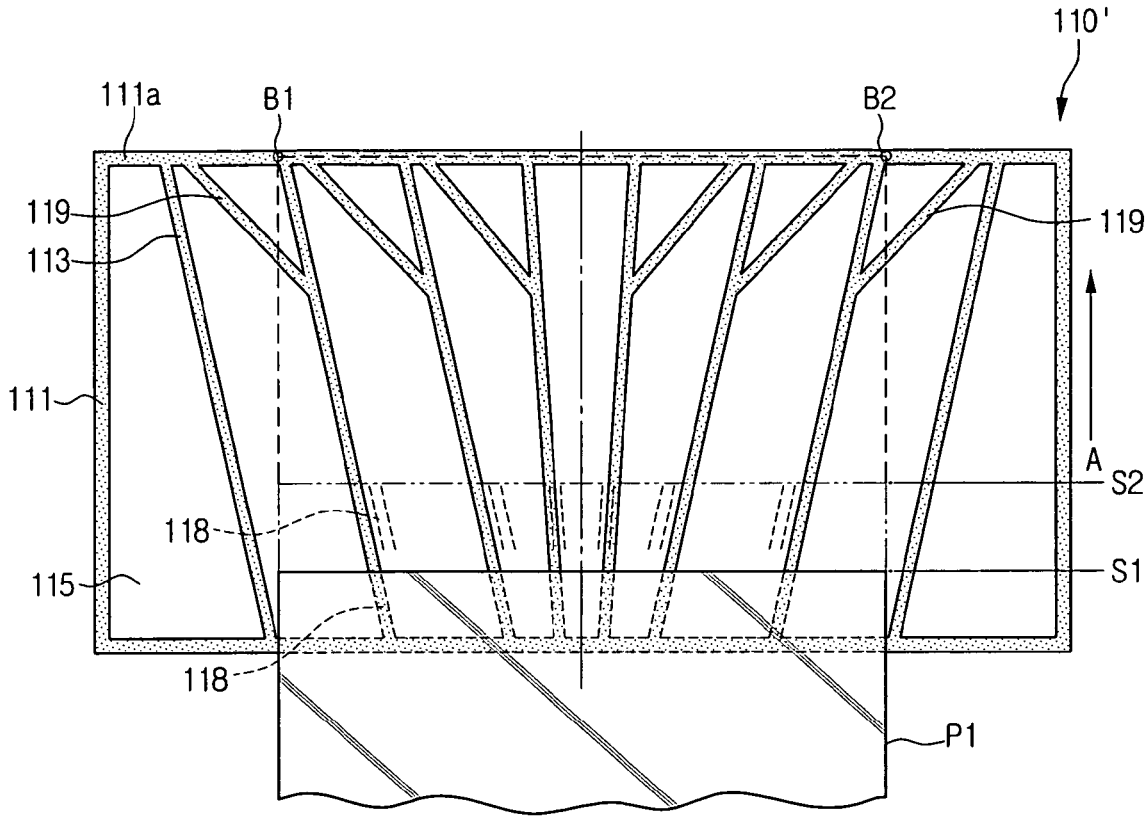
FIG. 7 is a plan view showing a printing paper moving above a discharge guide plate of the paper-discharging guide unit shown in FIG. 2.

The operation of the paper-discharging guide unit described above will be explained hereinafter, with reference to FIGS. 2 and 7. When the printing paper P comes out of a fusing unit 240 (see FIG. 8) and enters onto the discharge guide plate 110, the absorbing fan 122 operates and generates a suction force. When passing through the fusing unit 240, the printing paper P soaks up volatile organic compound gases of the carrier of the liquid toner. When the printing paper P enters onto the discharge guide plate 110, the volatile organic compound gases soaked in the printing paper P are vaporized and emitted from the printing paper P. Therefore, the volatile organic compound gases coming out of the printing paper P are absorbed into the air-absorbing portion 120 through the plurality of spaces 115 between the guide frame 111 and the plurality of guide ribs 113 and branch ribs 119 by the suction force. Also, the volatile organic compound gases remaining in the printing paper P are absorbed into the air-absorbing portion 120 by the suction force. At this time, the volatile organic compound gases remaining in the area 118 of the printing paper P1 that is touching the plurality of guide ribs 113 is not absorbed into the air-absorbing portion 120 because the guide ribs 113 block the area 118 of the printing paper P1. However, because the plurality of guide ribs 113, as shown in FIG. 7, are symmetrically slanted, the area 118 of the printing paper P1 that touched the plurality of guide ribs 113 moves on the plurality of spaces 115 between the plurality of guide ribs 113 as the printing paper P1 moves downstream. In other words, when the printing paper P1 moves from the position S1 to the position S2 in the discharge direction A, the printing paper area 118 which was touching the plurality of guide ribs 113 in the S1 position is now located on the space 115 in the position S2. Therefore, the volatile organic compound gases which remained in the area 118 of the printing paper P1 are now absorbed into the air-absorbing portion 120 by the suction force. Accordingly, when the printing paper P1 passes through the discharge guide plate 110, all of the volatile organic compound gases are absorbed into the air-absorbing portion 120 since the suction force is applied to the entire area of the printing paper P1.

Also, though one or both corners of the leading edge of the printing paper P1 located on the space 115 are bent by the suction force, the corners are straightened out as the printing paper P1 moves downstream in the discharge direction A. This is because both corners of the printing paper P1, as shown in FIG. 7, are supported by the plurality of guide ribs 113 or branch ribs 119 slanted to diverge downstream of the discharge direction A. Furthermore, both corners of the printing paper P1 are supported by two points B1, B2, where one pair of the plurality of guide ribs 113 and branch ribs 119 meets the downstream side 111*a* of the guide frame 111. Thus, the printing paper P1 comes out of the discharge guide plate 110 and enters into the pair of discharging rollers 250 (see FIG. 8) in a state that the leading edge of the printing paper P1 is straightened. Therefore, neither of the corners of the printing paper are folded.

Figure 8:
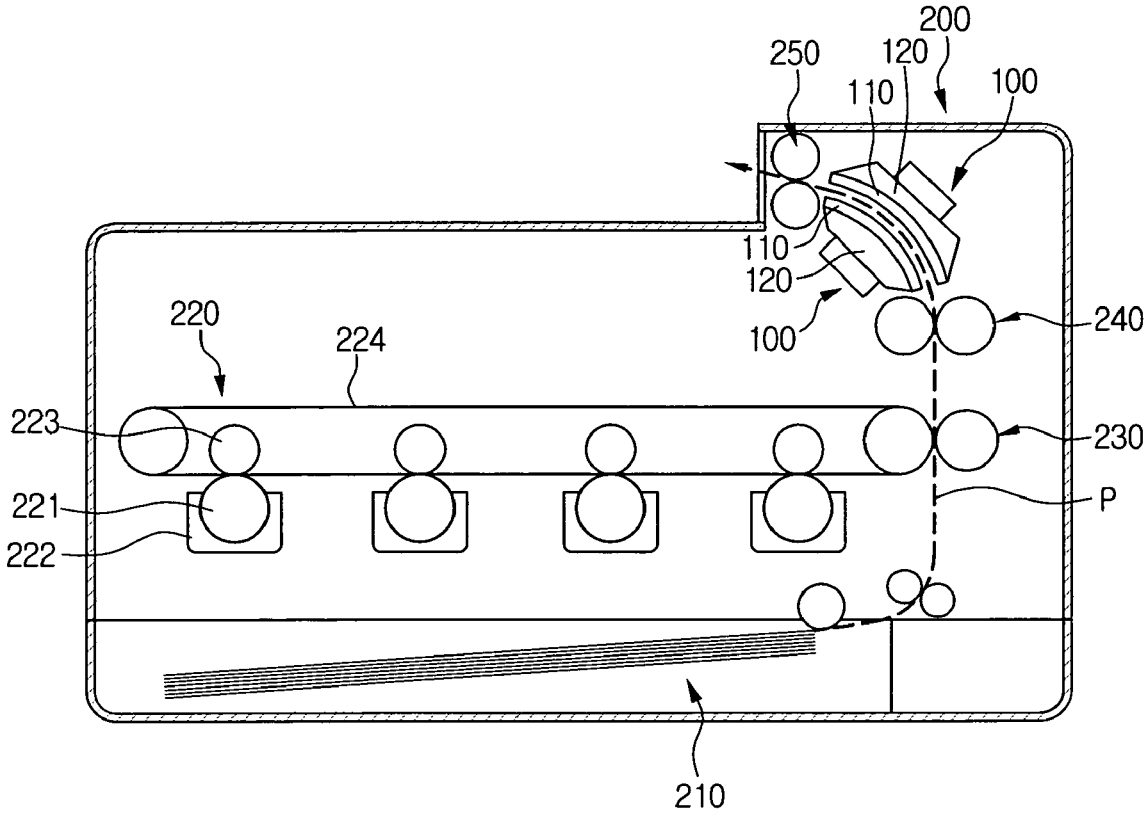
FIG. 8 is a schematic view of a wet electrophotographic image forming apparatus having a paper-discharging guide unit according to an embodiment of the present invention.

FIG. 8 schematically shows a wet electrophotographic image forming apparatus having a paper-discharging guide unit according to an embodiment of the present invention. Referring to FIG. 8, the wet image forming apparatus 200 includes a paper feeding unit 210 that picks up one by one a printing paper P such as a sheet of paper. The paper feeding unit 210 feeds an image forming unit 220 that forms a predetermined color image on a transfer belt 224. A second transfer roller 230 transfers the color image formed on the transfer belt 224 to the printing paper P. A fusing unit 240 fixes the transferred color image onto the printing paper P. A paper-discharging guide unit 100 forms a passage in which the printing paper P moves to a pair of discharging rollers 250 and absorbs volatile organic compound gases soaked in the printing paper P. A pair of discharging rollers 250 discharge the printing paper P outside the wet image forming apparatus 200. At this time, the paper-discharging guide unit 100 may be disposed below or above the moving passage of the printing paper P between the fusing unit 240 and the pair of discharging rollers 250. Preferably, however, two paper-discharging guide units 100 are disposed below and above the moving passage as shown in FIG. 8 for efficiently removing the volatile organic compound gases from the printing paper P.

The image forming unit 220 has a laser scanning unit (not shown) that scans a laser beam according to printing data, a plurality of photosensitive media 221 on which a predetermined electrostatic latent image is formed by the laser beam, a plurality of developers 222 developing each of the electrostatic latent images formed on the plurality of photosensitive media 221 into a predetermined color image, a transfer belt 224 on which the developed images on the plurality of photosensitive media 221 are respectively transferred and superimposed, and a plurality of first transfer rollers 223 for transferring the developed images on the plurality of photosensitive media 221 to the transfer belt 224.

The paper-discharging guide unit 100 has a discharge guide plate 110 and an air-absorbing portion 120. The discharge guide plate 110 is disposed between a fusing unit 240 and a pair of discharging rollers 250 and guides a printing paper P passing through the fusing unit 240 toward the pair of discharging rollers 250. The discharge guide plate 110 has a guide frame 111 that forms a moving passage of the printing paper P and a plurality of guide ribs 113 that are disposed inside the guide frame 111 and support the printing paper P moving thereon. There are a plurality of spaces 115 between the guide frame 111 and the plurality of guide ribs 113. The discharge guide plate 110 also has a plurality of branch ribs 119 to prevent the corners of the printing paper P from being folded (see FIG. 4). The air-absorbing portion 120 is disposed below the discharge guide plate 110 to absorb air from the plurality of spaces 115 between the guide frame 111 and the plurality of guide ribs 113 and branch ribs 119 of the discharge guide plate 110. The air-absorbing portion 120 is comprised of a duct 121 that is connected to a lower portion of the guide frame 111 and an absorbing fan 122 disposed at an end of the duct 121 (see FIG. 2). The description of these elements will not be repeated here since they are similar to the embodiment of the paper-discharging guide unit described above.

The operation of the wet image forming apparatus 200 will now be explained with reference to FIGS. 2, 7, and 8. According to a printing signal from a control unit (not shown), a laser beam emitted from the laser-scanning unit (not shown) forms a predetermined electrostatic latent image on each of the plurality of photosensitive media 221. The electrostatic latent images formed on the plurality of photosensitive media 221 are respectively developed into predetermined color images by the plurality of developers 222. At this time, the plurality of the developers 222 develops the electrostatic latent images of the plurality of photosensitive media 221 with a liquid toner. The liquid toner is composed of toner particles and a carrier liquid. The carrier liquid contains volatile organic compounds. The image developed into the predetermined color by the liquid toner on each surface of the plurality of photosensitive media 221 is transferred to and superimposed on the transfer belt 224 by the first transfer roller 223 and thereby forms a color image. The color image formed on the transfer belt 224 is transferred to a printing paper P fed from the paper-feeding unit 210 by a second transfer roller 230. The color image that is transferred from the transfer belt 224 to the printing paper P is fixed onto the printing paper P by the heat and pressure of the fusing unit 240. At this time, the heat of the fusing unit 240 vaporizes the volatile organic compounds contained in the liquid toner that forms the color image. Some of the vaporized volatile organic compounds soak into the printing paper P.

The printing paper P with the fixed color image moves onto the discharge guide plate 110 of the paper-discharging guide unit 100. At this time, some of the volatile organic compound gases soaked into the paper during the fusing process come out of the printing paper P. The volatile organic compound gases that come out of, as well as the gases that remain in the printing paper P, are absorbed into the air-absorbing portion 120 by the suction force generated thereby. At this time, since the printing paper P is supported by a plurality of guide ribs 113 and branch ribs 119 formed in a shape of a letter 'V,' the volatile organic compound gases are absorbed from the entire area of the printing paper P. Since the operation of the paper-discharging guide unit 100 is similar to that described above, a detailed explanation of the operation will not be repeated. The volatile organic compound gases absorbed in the air-absorbing portion 120 are decomposed into harmless gases in an exhaust gas decomposing apparatus (not shown) and then are exhausted to the atmosphere.

Also, though one or both corners of the leading edge of the printing paper P located on the space 115 of the discharge guide plate 110 are bent toward a suction direction by the suction force, the corners of the paper are straightened before the printing paper P enters into the pair of discharging rollers 250. This is because both corners of the printing paper P are supported by the plurality of guide ribs 113 or branch ribs 119 and by the two points B1, B2 where a pair of the plurality of guide ribs 113 or branch ribs 119 meets the downstream side 111*a* of the guide frame 111. Therefore, neither of the corners of the printing paper are folded.

While the invention has been shown and described with reference to certain embodiments thereof, it will be understood by those skilled in the art that various changes in form and details may be made therein without departing from the spirit and scope of the invention as defined by the appended claims.

What is claimed is:

1. A paper-discharging guide unit, comprising:

a guide frame forming a discharge passage for a printing paper;

a plurality of guide ribs formed in pairs of slanted lines symmetrical with respect to a centerline of the discharge direction of the printing paper inside the guide frame, the plurality of guide ribs guiding the printing paper;

a plurality of branch ribs disposed downstream of the plurality of guide ribs, the plurality of branch ribs formed to be slanted steeper with respect to the centerline of the guide frame than the plurality of guide ribs; and an air-absorbing portion disposed below the guide frame, the air-absorbing portion absorbing air from a plurality of spaces between the guide frame and the plurality of guide ribs.

2. The paper-discharging guide unit of claim 1, wherein the plurality of guide ribs are slanted and diverge toward the discharge direction of the printing paper.

3. The paper-discharging guide unit of claim 1, wherein the plurality of guide ribs or branch ribs are disposed so that two points where a pair of guide ribs or branch ribs among the plurality of guide ribs and branch ribs meet a downstream side of the guide frame correspond to a width of the printing paper guided by the guide frame.

4. The paper-discharging guide unit of claim 1, wherein the plurality of guide ribs are formed in the shape of slanted lines that do not meet inside the guide frame.

5. A wet electrophotographic image forming apparatus, comprising:

a fusing unit fixing an image on a printing paper;

a guide frame guiding the printing paper passing through the fusing unit;

a plurality of guide ribs formed in pairs of slanted lines symmetrical with respect to a centerline of the moving direction of the printing paper, the plurality of guide ribs being located inside the guide frame and supporting the printing paper;

a plurality of branch ribs disposed downstream of the plurality of guide ribs, the plurality of branch ribs formed to be slanted steeper with respect to the centerline of the guide frame than the plurality of guide ribs;

an air-absorbing portion disposed below the guide frame, the air-absorbing portion absorbing volatile organic compound gases contained in the printing paper through a plurality of spaces between the guide frame and the plurality of guide ribs; and a pair of discharging rollers discharging the printing paper passed through the guide frame.

6. The wet electrophotographic image forming apparatus of claim 5, wherein the plurality of guide ribs are slanted and diverge toward the discharge direction of the printing paper.

7. The wet electrophotographic image forming apparatus of claim 5, wherein the plurality of guide ribs or branch ribs are disposed so that two points where a pair of guide ribs or branch ribs among the plurality of guide ribs and branch ribs meet a downstream side of the guide frame correspond to a width of the printing paper guided by the guide frame.

8. The wet electrophotographic image forming apparatus of claim 5, wherein the plurality of guide ribs are formed in the shape of slanted lines that do not meet inside the guide frame.

9. A wet electrophotographic image forming apparatus, comprising:

a fusing unit that fixes an image on a printing paper;

a first paper discharging guide unit for guiding paper received from the fusing unit, comprising:

a discharge guide plate with a guide frame that guides the printing paper passing through the fusing unit and a plurality of guide ribs mounted inside the guide frame, the guide ribs being formed in pairs of slanted lines that are symmetrical with respect to a centerline of the guide frame, the guide ribs forming a plurality of spaces between the guide frame and the guide ribs;

a plurality of branch ribs disposed downstream of the plurality of guide ribs, the plurality of branch ribs formed to be slanted steeper with respect to the centerline of the guide frame than the plurality of guide ribs; and an air-absorbing portion disposed below the guide frame, the air-absorbing portion absorbing volatile organic compound gases contained in the printing paper through the plurality of spaces; and a pair of discharging rollers for discharging the printing paper from the image forming apparatus.

10. The wet electrophotographic image forming apparatus of claim 9, wherein the plurality of guide ribs are V-shaped.

11. The wet electrophotographic image forming apparatus of claim 9, wherein the plurality of guide ribs or branch ribs are disposed so that the intersection between a pair of guide ribs or branch ribs and the downstream side of the guide frame corresponds to a width of the printing paper being guided by the guide frame.

12. The wet electrophotographic image forming apparatus of claim 9, wherein the plurality of guide ribs are formed in a truncated V-shape.

13. The wet electrophotographic image forming apparatus of claim 9, wherein the air-absorbing portion comprises:

a duct that is connected to a lower portion of the guide frame; and an absorbing fan disposed at an end of the duct.

14. The wet electrophotographic image forming apparatus of claim 9, further comprising:

a second paper discharging guide unit for guiding paper received from the fusing unit, the second paper discharging guide unit being located on the opposite side of the printing paper.

15. The wet electrophotographic image forming apparatus of claim 14, wherein the second paper discharging guide unit comprises:

a discharge guide plate with a guide frame that guides the printing paper passing through the fusing unit and a plurality of guide ribs mounted inside the guide frame, the guide ribs being formed in pairs of slanted lines that are symmetrical with respect to a centerline of the guide frame, the guide ribs forming a plurality of spaces between the guide frame and the guide ribs; and an air-absorbing portion disposed below the guide frame, the air-absorbing portion absorbing volatile organic compound gases contained in the printing paper through the plurality of spaces.

16. The wet electrophotographic image forming apparatus of claim 15, wherein the first paper discharging guide unit further comprises:

the plurality of branch ribs mounted in the guide plate.

17. The wet electrophotographic image forming apparatus of claim 16, wherein the second paper discharging guide unit further comprises:

a plurality of branch ribs mounted in the guide plate.

* * * * *